United States Patent [19]

Kampichler

[11] Patent Number: 4,617,894

[45] Date of Patent: Oct. 21, 1986

[54] GOVERNOR MECHANISM COUNTERBALANCE FOR A FUEL INJECTED INTERNAL COMBUSTION ENGINE OF A VEHICLE

[75] Inventor: Guenter Kampichler, Ruhstorf, Fed. Rep. of Germany

[73] Assignee: Motorenfabrik Hatz GmbH & Co. KG, Ruhstorf, Fed. Rep. of Germany

[21] Appl. No.: 729,380

[22] Filed: May 1, 1985

[30] Foreign Application Priority Data

May 3, 1984 [DE] Fed. Rep. of Germany ..... 3416355

[51] Int. Cl.[4] ..... F02M 39/00

[52] U.S. Cl. ..... 123/372; 123/192 R; 123/364

[58] Field of Search ..... 123/509, 372-374, 123/364, 192 R; 74/590

[56] References Cited

U.S. PATENT DOCUMENTS

| | | | |
|---|---|---|---|
| 2,819,618 | 1/1958 | Slusher | 74/590 |
| 3,205,728 | 9/1965 | Morris | 74/590 |
| 3,903,860 | 9/1975 | Maier | 123/374 |
| 4,372,267 | 2/1983 | Adams | 123/372 |
| 4,381,043 | 4/1983 | Fukushima | 123/192 R |
| 4,512,305 | 4/1985 | Pitozzi | 123/372 |

FOREIGN PATENT DOCUMENTS

| | | | |
|---|---|---|---|
| 119946 | 9/1984 | European Pat. Off. | 123/450 |
| 2626370 | 12/1976 | Fed. Rep. of Germany | 123/450 |
| 3105412 | 9/1982 | Fed. Rep. of Germany | 123/509 |

*Primary Examiner*—Carl Stuart Miller

*Attorney, Agent, or Firm*—Flynn, Thiel, Boutell & Tanis

[57] ABSTRACT

A fuel injected internal combustion engine which drives a device such as a vehicle which is susceptible to sudden undesirable acceleration or deceleration is provided with injection pumps having fuel quantity control members which are coupled to an activator which in turn effects simultaneous adjustment of the control members under the control of an operator. At least one mass is coupled to the activator and prevents or compensates for undesired forces tending to effect movement of the control members as a result of accidental acceleration or deceleration of the device.

10 Claims, 4 Drawing Figures

GOVERNOR MECHANISM COUNTERBALANCE FOR A FUEL INJECTED INTERNAL COMBUSTION ENGINE OF A VEHICLE

FIELD OF THE INVENTION

This invention relates to a fuel injected internal combusion engine and, more specifically, to such an engine which is used in devices such as a vehicle and which has a plurality of injection pumps with fuel quantity governing members controlled by an activator, the activator facilitating simultaneous control of the control members by an operator.

BACKGROUND OF THE INVENTION

It is well known that, during sudden acceleration or deceleration of a vehicle, internal forces are induced in the governor mechanism of the engine and can upset the appropriate setting thereof in an undesired manner. Depending upon the manner of installation of the engine in the vehicle, an undesired effect can, for example, occur during sudden braking of the vehicle and during disengagement of the vehicle drive, resulting in a reduction of the speed of the engine to a point where the engine stalls. In other cases, the engine may be caused to race and to exceed the setting if the governor mechanism is moved in a direction toward maximum fuel quantity injection by a sudden braking of the vehicle.

SUMMARY OF THE INVENTION

An object of this invention is to obviate these disadvantages. According to the invention, this is achieved by coupling at least one weight to the activator, the weight compensating for the undesired effect upon members of the governor mechanism produced by sudden acceleration or deceleration of the vehicle. The weight may be a pendulum member supported on the vehicle and subject to the force of gravity. Alternatively, the weight may be a slidable balancing member supported for movement parallel to the direction of movement of the activator and coupled to the activator so as to move in a direction opposite to the direction of movement of the activator.

BRIEF DESCRIPTION OF THE DRAWINGS

There will now be described, with reference to the drawings, two embodiments of the invention. It will be understood that the particular embodiments described are given by way of example only.

In the drawings.

DETAILED DESCRIPTION

Figure 1:
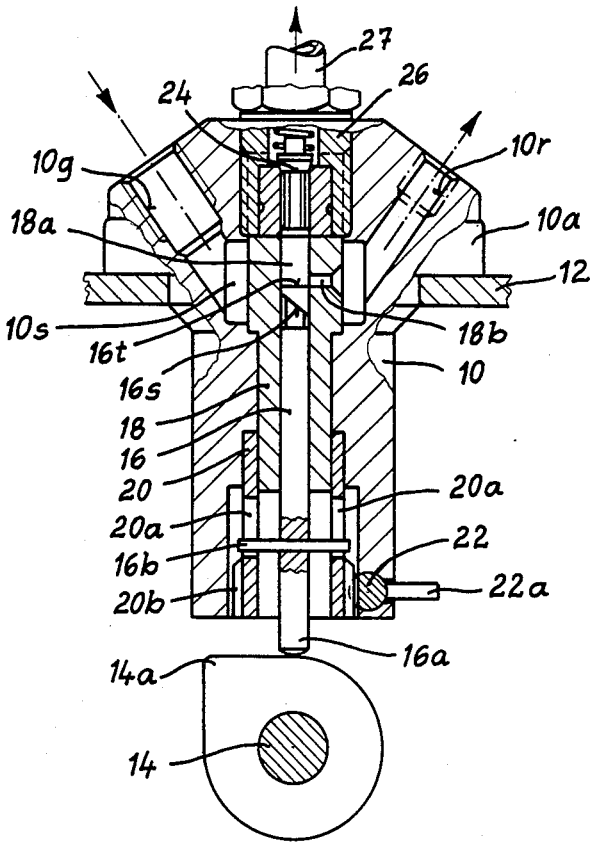
FIG. 1 is a longitudinal sectional view of a piston operated injection pump and a drive cam therefor.

FIG. 1 shows a fuel injection pump 10 which is secured from the outside, by means of a flange 10*a* thereon, on the casing 12 of an engine. Positioned in the interior of the engine is a drive shaft 14 which has a drive cam 14*a* thereon and which is coupled in a conventional manner with a not illustrated control element of the engine which effects rotation of the shaft 14. The drive cam 14*a* works in a conventional manner in conjuction with an end 16*a* of a pump piston 16. The piston 16 is axially slidable in a sleeve 18 and can be rotated around its longitudinal axis by a rotatable control bush 20. In particular, a carrier pin 16*b* is secured in the piston 16 and slides in longitudinal slots 20*a* provided in the control bush 20. A longitudinally movable operating rod 22 has teeth which mesh with circumferential teeth 20*b* provided on the control bush 20 and can thus rotate the elements 16 and 20 to effect a regulation of the fuel quantity injected. The piston 16 has a control edge 16*s* and an end face edge 16*t* which operate in a conventional manner in conjunction with an inlet port 18*b* in the piston sleeve 18 which communicates with an operating chamber 18*a* for the piston so as to effect fuel quantity regulation. A threaded opening 10*g* is used to connect the pump 10 to a suction line (not shown), which is in turn connected to a conventional and not illustrated fuel tank and carries fuel to the suction chamber 10*s* of the pump 10. A further threaded opening 10*r* is provided to connect the pump 10 to a return flow line (not shown) which carries excess unburned fuel back to the tank. A spring-biased pressure valve 24 adjoins the piston operating chamber 18*a*, the valve 24 lying within a pressure line union connection 26. The pressure line itself is identified with reference numeral 27. Each of the operating rods 22 has thereon a coupling pin 22*a* which projects away from the pump 10 and slidably engages a respective carrier slot 28*a* provided in a common engine control rod 28. The control rod 28 is guided by a plurality of guide pins 30 slidably received in slots in the control rod 28 for movement parallel to the individual pump operating rods 22. The control rod 28 is operated directly or indirectly by a gas pedal controlled by the vehicle driver, so that all pump operating rods 22 are moved the same distance at the same time.

In order to obviate the disadvantages explained in detail in the introduction, the following balancing mechanism according to the invention is provided. The control rod 28 has a guide slot 28*b* in which a coupling pin 32*a* is received, the pin 32*a* being rigidly secured to one end of a double arm pivot lever 32. The pivot lever 32 is pivotally supported by an axle 32*b* in a bearing 34 provided on the vehicle chassis. The other arm of the pivot lever 32 carries an axle 32*c* on which a pendulum disc 36, which serves as a counterbalance, is supported so as to be freely rotatable. If an unintended and sudden movement of the parts 22–28 of governor mechanism of the engine were to take place, for example in the direction of the arrow A, then the pivot lever 32 will execute a rotational movement in a clockwise direction. The pendulum disc 36 suspended on its axle 32*c* is carried in the direction of the arrow B and produces, as a result of its weight and the force of gravity, an inertial function which inhibits or compensates for the undesired adjusting movement of the governor mechanism. Conversely, the pendulum disc 36 will move in the opposite direction to that of the arrow B during a sudden movement of the control rod 28 in a direction opposite to the arrow A and, in a similar manner, achieve compensation.

Figure 4:
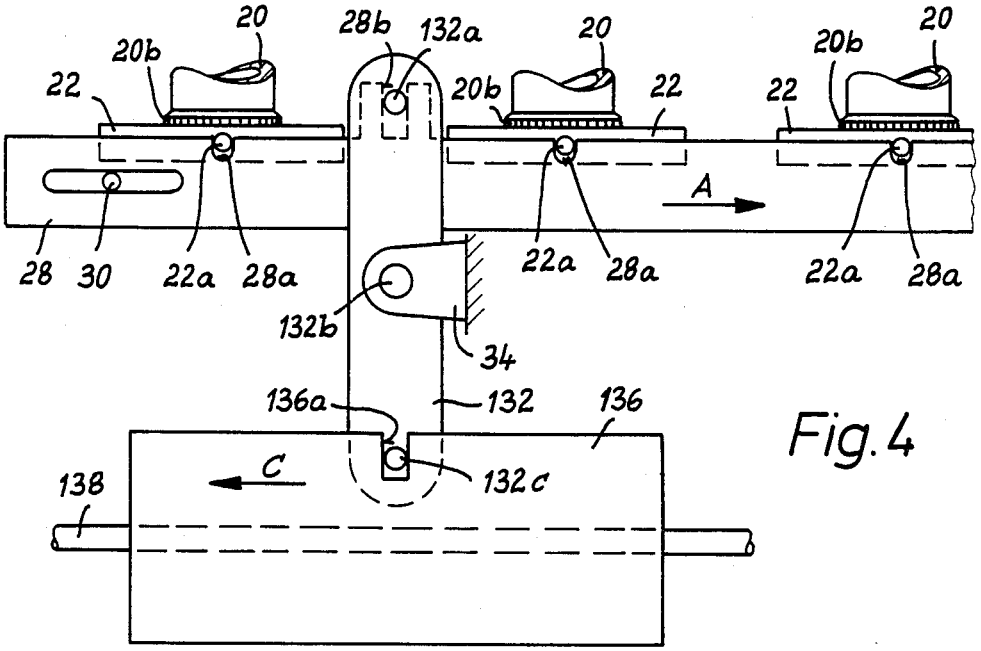
FIG. 4 is a view similar to FIG. 2 of a second embodiment of the counter-balance mechanism of FIG. 2.
Figure 2:
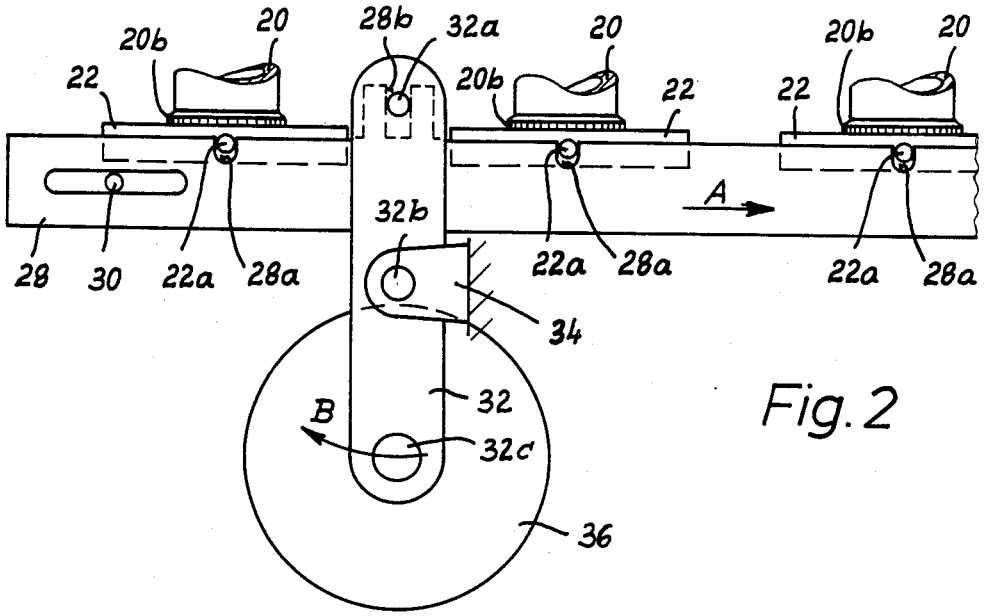
FIG. 2 is a side view of a counter-balance mechanism for controlling several injection pumps of the type shown in FIG. 1.
Figure 3:
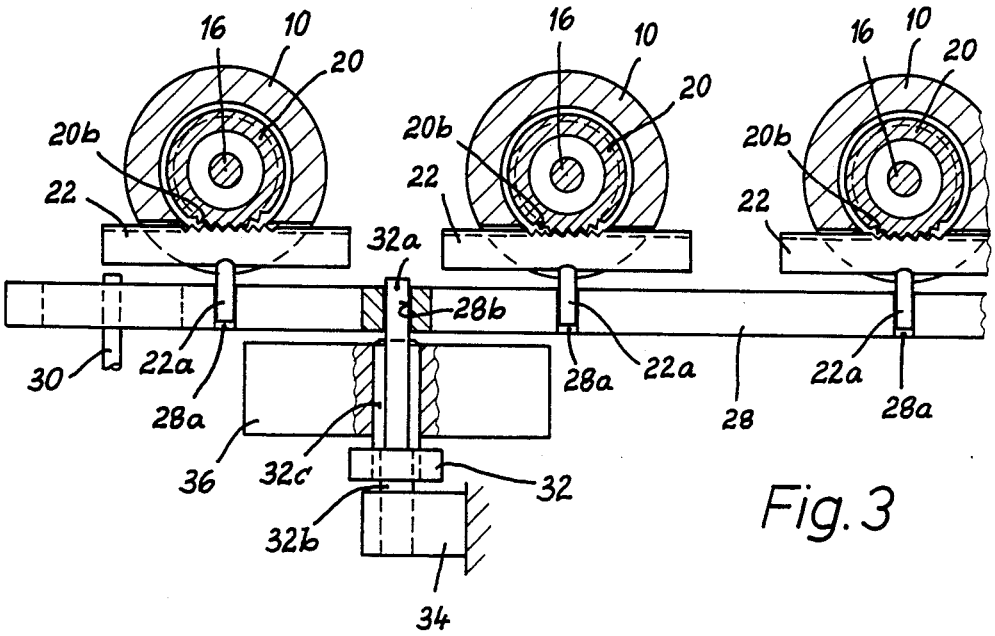
FIG. 3 is a top view, partly in section, of the counter-balance mechanism of FIG. 2.

FIG. 4 shows a balancing mechanism which is similar in many respects to the embodiment of FIG. 2. Therefore, the same parts are referred to in each case with identical reference numerals. However, the pivot lever 132 of FIG. 4 does not carry a pendulum disc, but instead is coupled to a balancing element 136 by a pin 132*c* thereon which engages a guide slot 136*a* provided in the balancing element 136. The balancing element 136 is slidable on a guide rod 138 which extends parallel to the directions of movement of the control rod 28. During an undesired and sudden shifting movement of the control parts in the direction of the arrow A, the pivot lever 132 rotates in a clockwise direction and its pin 132*c* moves the balancing member 136 in direction C.

The sum of all masses in the governor mechanism which act upon the control rod 28 is to be equalized with respect to the mass of the balancing member 136 (with due regard to the leverage of the pivot lever 132). Since the mass of the governor mechanism, the mass of the member 36, and the fulcrum defined by bearing 34 and axle 132*b* all experience the same acceleration or deceleration during sudden changes in movement of the vehicle, full balancing of the forces occurs. As a result, inhibiting of or compensation for the undesired shifting movements of the governor mechanism in this example is achieved.

The balancing mechanism in accord with the invention is not solely restricted to use on vehicles, but can also be used on other systems which are subjected to sudden and undesired acceleration or deceleration, for example ship drive motors, where severe wave motion can create such undesired movements.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined a follows:

1. A fuel injected internal combustion engine which is capable of driving a device such as a vehicle, said engine and device being susceptible to sudden undersirable acceleration or deceleration, comprising injection pumps having fuel quantity control members which are operatively coupled to an activator which facilitates simultaneous common control thereof by an operator; wherein at least one balancing mass is positively operatively coupled to said activator, said balancing mass preventing or compensating for undersired forces which tend to move said control members and said actuator and which are produced as a result of sudden acceleration or deceleration of the device; and wherein said balancing mass includes a slidable balancing member supported for movement parallel to the direction of movement of said activator and slidable in a direction opposite to the direction of movement of said activator.

2. The engine in accord with claim 1, wherein a double arm pivot lever is pivotally supported on a fulcrum bearing fixed on the vehicle, said lever being coupled at one end to said activator and at its other end to said balancing member, and wherein said balancing member is guided for sliding movement on a guide member which extends parallel to the direction of movement of said activator.

3. A fuel injected internal combustion engine which is capable of driving a device such as a vehicle, said engine and device being susceptible to sudden undesirable acceleration or deceleration, comprising: plural injection pumps having movable fuel quantity control members, activator means for facilitating simultaneous common control of said quantity control members by an operator, said activator means including a movable activator element which is operatively coupled to each of said fuel quantity control members; a double arm pivot lever pivotally supported on a fulcrum bearing fixed on said device, said lever being coupled at one end to said activator element and having at its other end a pivot member; and a balancing mass freely rotatably supported on said pivot member, said balancing mass compensating for undersired forces which tend to move said quantity control members and said activator element and which are produced by sudden acceleration or deceleration of said device.

4. The engine in accord with claim 3, wherein said lever extends generally vertically and said other end of said lever is the lower end thereof, said balancing mass and said lever serving as a pendulum which is subject to the force of gravity.

5. A fuel injected internal combustion engine adapted for use in a vehicle which is susceptible to sudden acceleration or deceleration, comprising: a plurality of fuel injection pumps which each have a movable fuel quantity control member; control means for facilitating simultaneous common control of said quantity control members, including an elongate control element supported for reciprocal lengthwise movement in first and second directions which are opposite each other, and including means for operatively coupling said control element to each of said quantity control members so as to effect simultaneous movement of said quantity control members in response to lengthwise movement of said control element; a balancing weight which is independent of said control means, and means supporting said balancing weight for reciprocal movement approximately parallel to said first and second directions; and means for operatively coupling said balancing weight and said control element in a manner so that, as said balancing weight moves in said first and second directions, said control element respectively moves in said second and first directions, and so that respective inertial forces simultaneously urging movement of said control element and said balancing weight in one of said first and second directions are exactly counterbalanced.

6. The engine in accord with claim 5, wherein said means for operatively coupling said balancing weight and said control element includes a lever which extends approximately transversely to said first and second directions and which is supported between its ends for pivotal movement about a stationary pivot axis extending transversely of said lever and transversely of said first and second directions, one end of said lever being operatively coupled to said control element and the other end thereof being operatively coupled to said balancing weight.

7. The engine in accord with claim 6, wherein said first and second directions extend generally horizontally, wherein said lever extends generally vertically and the lower end thereof is said other end, wherein said stationary pivot axis extends generally horizontally, wherein said means supporting said balancing weight includes a pivot pin provided at said other end of said lever and extending substantially parallel to said stationary pivot axis, and wherein said balancing weight is a circular disc having a central opening in which said pivot pin is received, said disc being freely rotatable relative to said pivot pin.

8. The engine in accord with claim 7, wherein said control element has an approximately vertically extending slot, and wherein said one end of said lever has a pin which is fixedly secured thereon, which extends approximately parallel to said stationery pivot axis and which is slidably received in said slot in said control element.

9. The engine in accord with claim 6, wherein said means supporting said balancing weight includes a guide rod which extends approximately parallel to said first and second directions, said balancing weight having an opening therethrough in which said guide rod is slidably received, wherein said balancing weight has a slot therein which extends approximately parallel to said lever, and wherein said other end of said lever has a pin which is fixedly secured thereon, which extends approximately parallel to said stationery pivot axis and which is slidably received in said slot in said balancing weight.

10. The engine in accord with claim 9, wherein said control element has therein a slot which extends approximately parallel to said lever, and wherein said lever has fixedly secured to said one end thereof a pin which extends approximately parallel to said stationary pivot axis and which is slidably received in said slot in said control element.

* * * * *